US005497518A

United States Patent [19]

Iura

[11] Patent Number: 5,497,518

[45] Date of Patent: Mar. 12, 1996

[54] ROTARY BED

[76] Inventor: Tadashi Iura, 172-4 Befucho, Matsuyama-shi, Ehime 791, Japan

[21] Appl. No.: 185,919

[22] PCT Filed: May 22, 1992

[86] PCT No.: PCT/JP92/00665

§ 371 Date: Apr. 28, 1994

§ 102(e) Date: Apr. 28, 1994

[87] PCT Pub. No.: WO93/24087

PCT Pub. Date: May 22, 1992

[51] Int. Cl.[6] ..... A47B 7/02

[52] U.S. Cl. ..... 5/618; 5/616

[58] Field of Search ..... 5/618, 616, 617

[56] References Cited

U.S. PATENT DOCUMENTS 4,312,500 1/1982 Janssen ..... 5/618
4,501,414 2/1985 Mason et al. ..... 5/618
4,862,530 9/1989 Chen ..... 5/618
5,095,561 3/1992 Green et al. ..... 5/618

*Primary Examiner*—Michael J. Milano
*Attorney, Agent, or Firm*—Armstrong, Westerman, Hattori, McLeland & Naughton

[57] ABSTRACT

The present invention has the object of providing a configuration of bed so that the fixed bed frame in rotary-type bed does not disturb care given to a physically handicapped person lying on the bed. A rotary bed frame (6) rotatable around a vertical axis is provided on the fixed bed frame (1) placed on the floor, with a front screen (3) attached to the front side, and a movable mat support member (23) which receives a mat (32) foldably provided, which is divided into a back receiving part, a waist receiving part and a leg receiving part, is provided on this rotary bed frame (6). The rotary bed frame (6) is rotated by an appropriate drive, and at the same time, the back receiving portion (23*b*) is caused to stand up prior to rotation. Furthermore, the front side portion of the bed frame (1) at least has a transverse width (L) permitting stepping over.

1 Claim, 20 Drawing Sheets

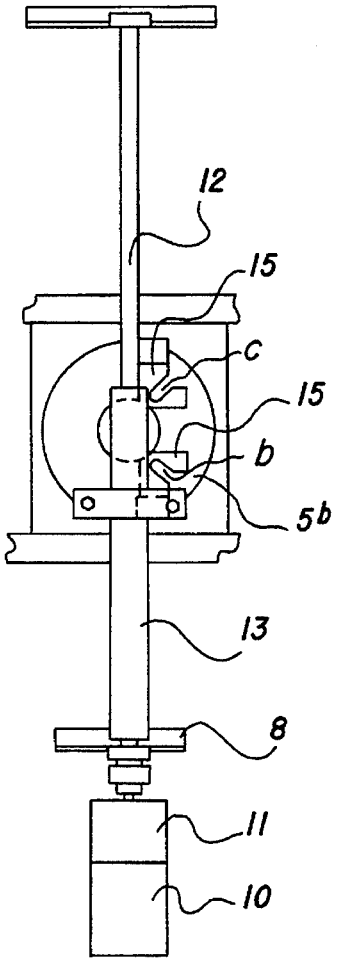
FIG.15
FIG.16
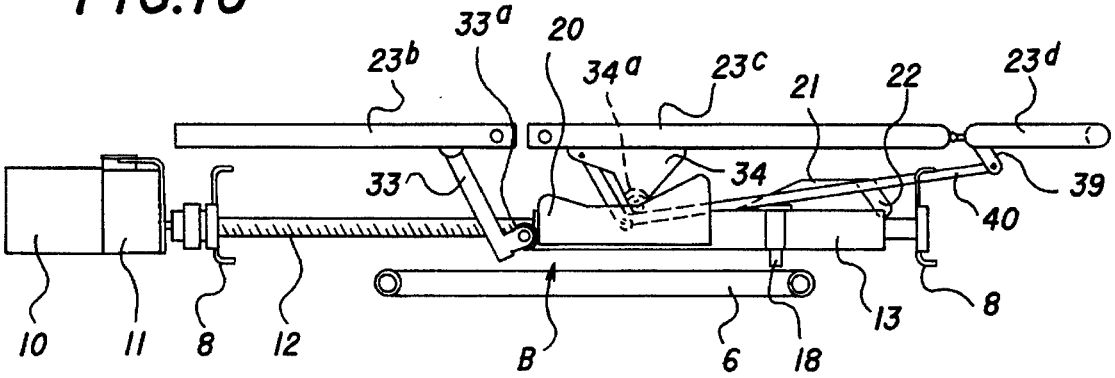

FIG.33
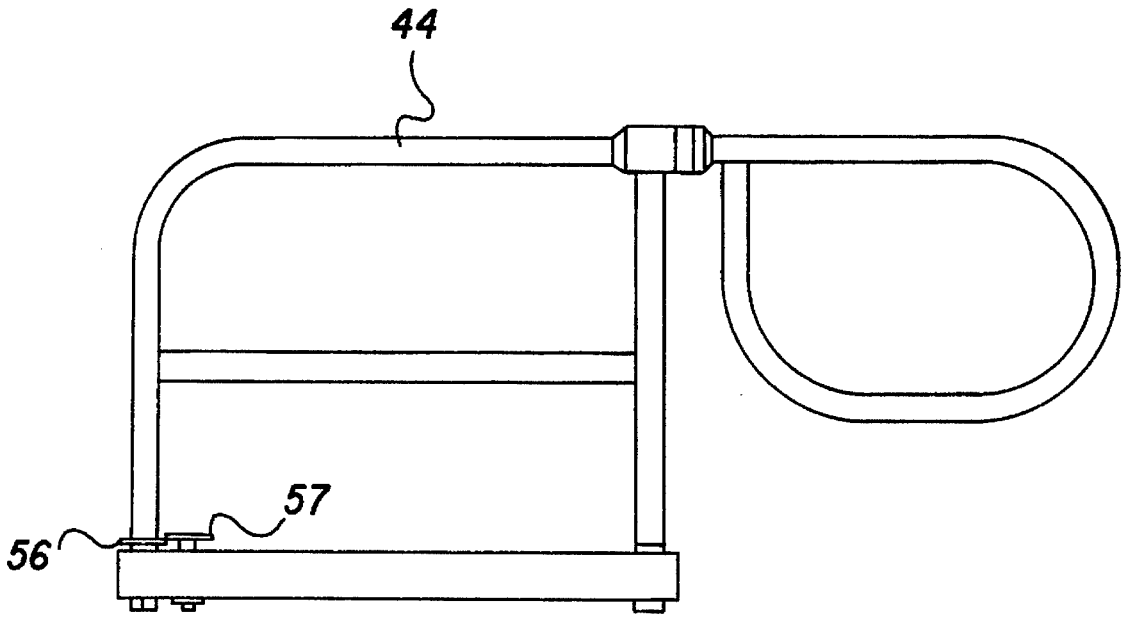
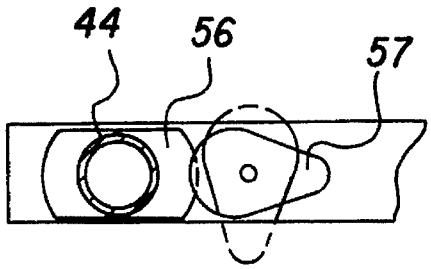
FIG.34

ROTARY BED

FIELD OF THE INVENTION

The present invention relates to a rotary-type bed used mainly by physically-handicapped or aged people.

PRIOR ART STATEMENT

The present inventor has conventionally manufactured and commercially sold a rotary-type bed which comprises a rotary bed frame, rotatable around a vertical axis, disposed in the middle between the front and rear portions of a fixed bed frame provided with front and rear screens; a movable mat support receiving a mat comprising at least a back receiving part, a waist receiving part and a leg receiving part independently foldable, attached to this rotary bed frame; and a driving mechanism to enable the user to get down from a side of the bed frame without being disturbed by the screen by rotating the rotary bed frame by about 90°, and to change his or her posture from lying down to sitting down by turning up the back receiving part and at the same time by lowering down the leg receiving part. The conventional rotary-type bed has, however, a construction in which the width of the bed frame placed stationarily on the floor surface is as wide as the mat width, and even when the user is caused to take a posture of sitting, as on an easy chair by turning up the back receiving part prior to rotating the rotary bed frame, an attendant cannot enter into the space between the screen and the upright back receiving part unless they stand up on the bed frame.

DISCLOSURE OF THE INVENTION

The present invention solves the difficulty in an attendant providing nursing care to a physically-handicapped or aged person who is in a sitting posture by entering the space between the front screen and the upright back receiving part, while remaining in a normal standing posture. The rotary-type bed of the present invention comprises a rotary bed frame 6, rotatable around a vertical axis, provided in the middle between the front and rear portions of a fixed bed frame 1 provided with at least a front screen 3 on the front end side and placed on the floor surface; a movable mat support member 23 receiving a mat 32 comprising at least a back receiving portion 23*b*, a waist receiving portion 23*c* and a leg receiving portion 23*d* independently foldable, attached to this rotary bed frame 6; a leg, receiving mat support 41, a receiving mat 42 for receiving legs, provided on the rear end side of the fixed bed frame 1; a reversely rotatable motor 10 and a screw cylinder 13 engaging with a screw shaft 12 rotated at a reduced speed by the motor 10 being attached to a side of said rotary bed frame; and a rotation mechanism A for mechanically rotating the rotary bed frame 6 by about 90° relative to the movement of the screw cylinder and an interlocking mechanism B for causing folding of the back receiving portion 23*b*, the waist receiving part 23*c* and the leg receiving portion 23*d*, the both mechanisms being provided between the screw cylinder 13 and the fixed bed frame 1. This achieves an interlocking structure in which, prior to starting rotation of the rotary bed frame 6, simultaneously with the raising of the back receiving portion 23*b*, the leg receiving portion 23*d* is raised so as not to hit the mat 42 for receiving legs. The front side portion of the bed frame at least has a narrow width sufficient to permit stepping over.

BRIEF DESCRIPTION OF THE DRAWINGS

FIG. 15 is a partial plan view illustrating the function of the rotating mechanism A. FIG. 16 is a partial descriptive view illustrating the operating mechanism of the movable mat support member 23. FIG. 33 is a partial side view illustrating fitting of the siderail. FIG. 34 is a plan view illustrating the stopper portion of the siderail.

PREFERRED EMBODIMENTS OF THE INVENTION

Figure 1:
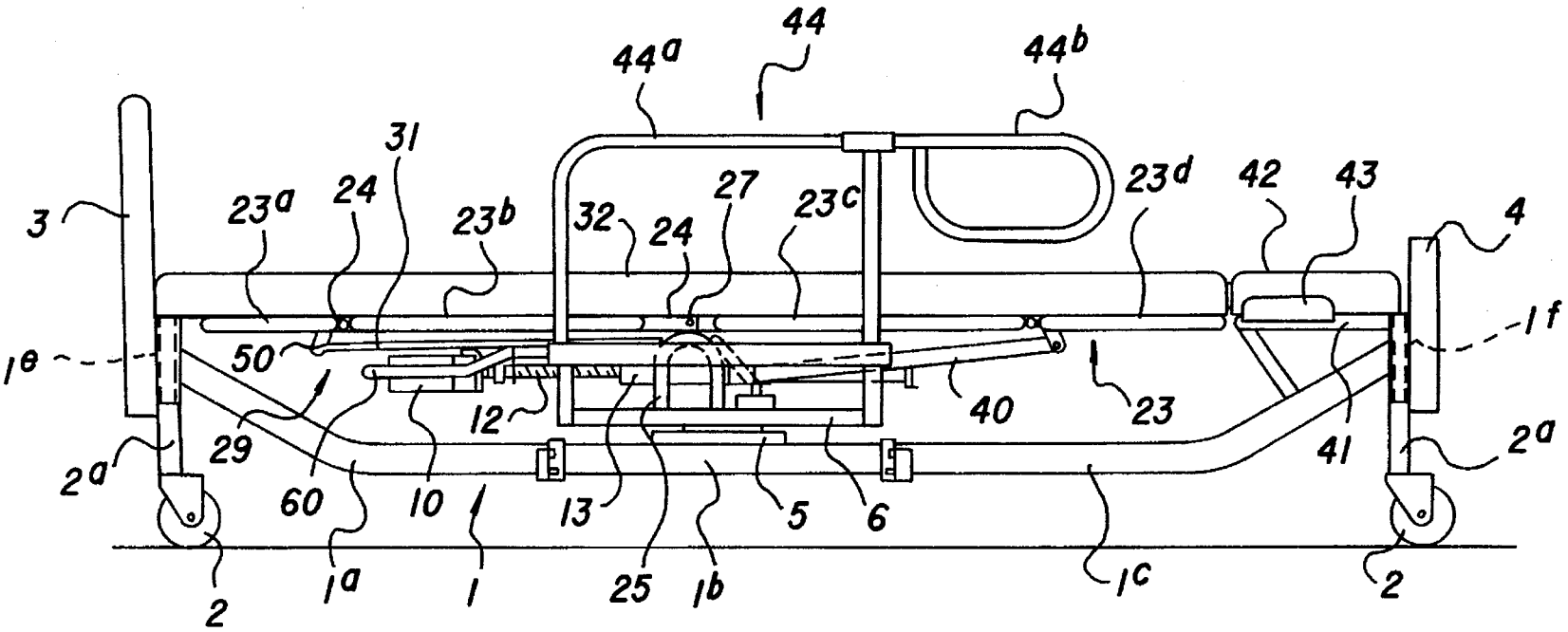
FIG. 1 is a partially simplified side view.
Figure 2:
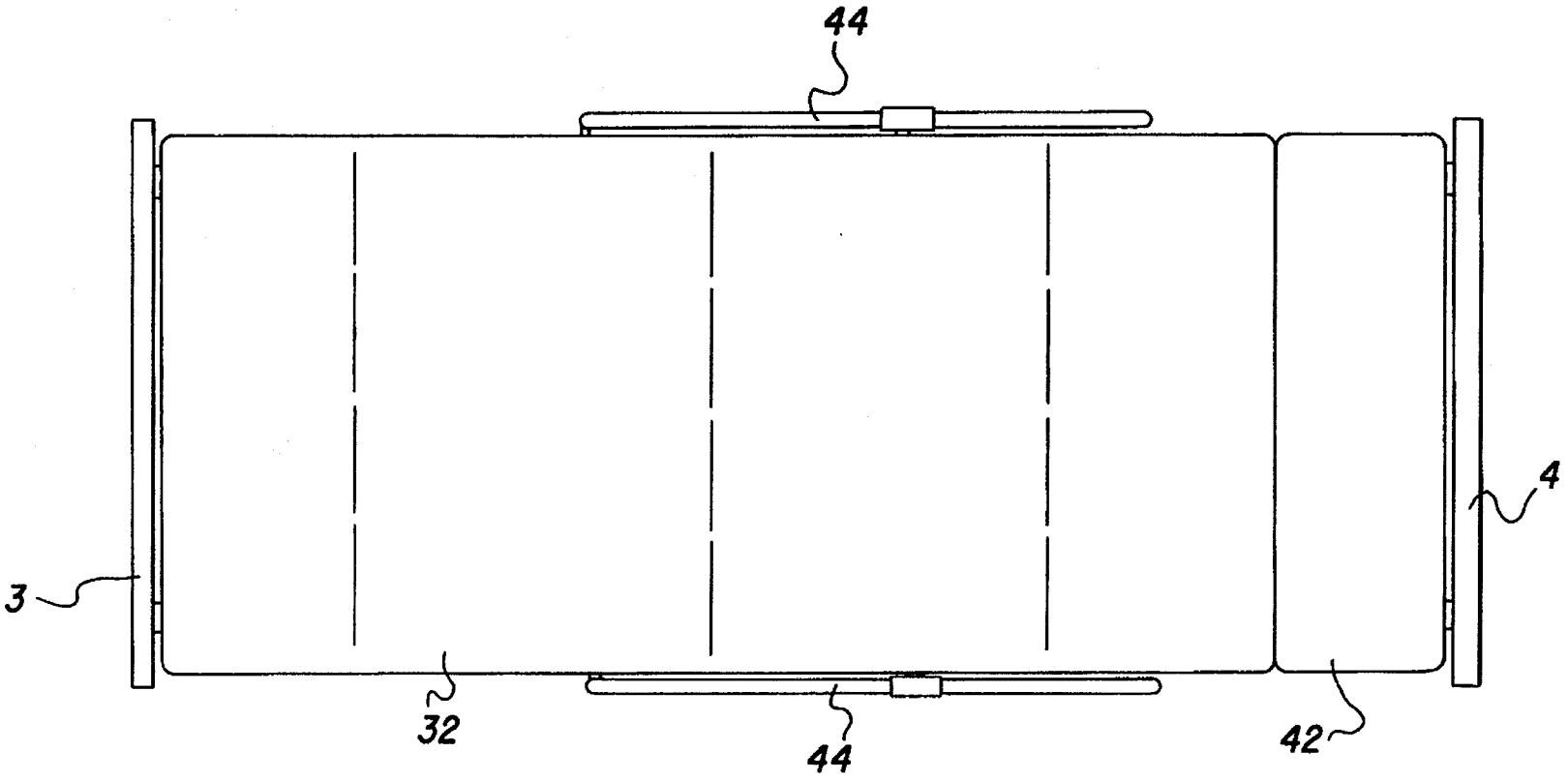
FIG. 2 is a simplified plan view.
Figure 3:
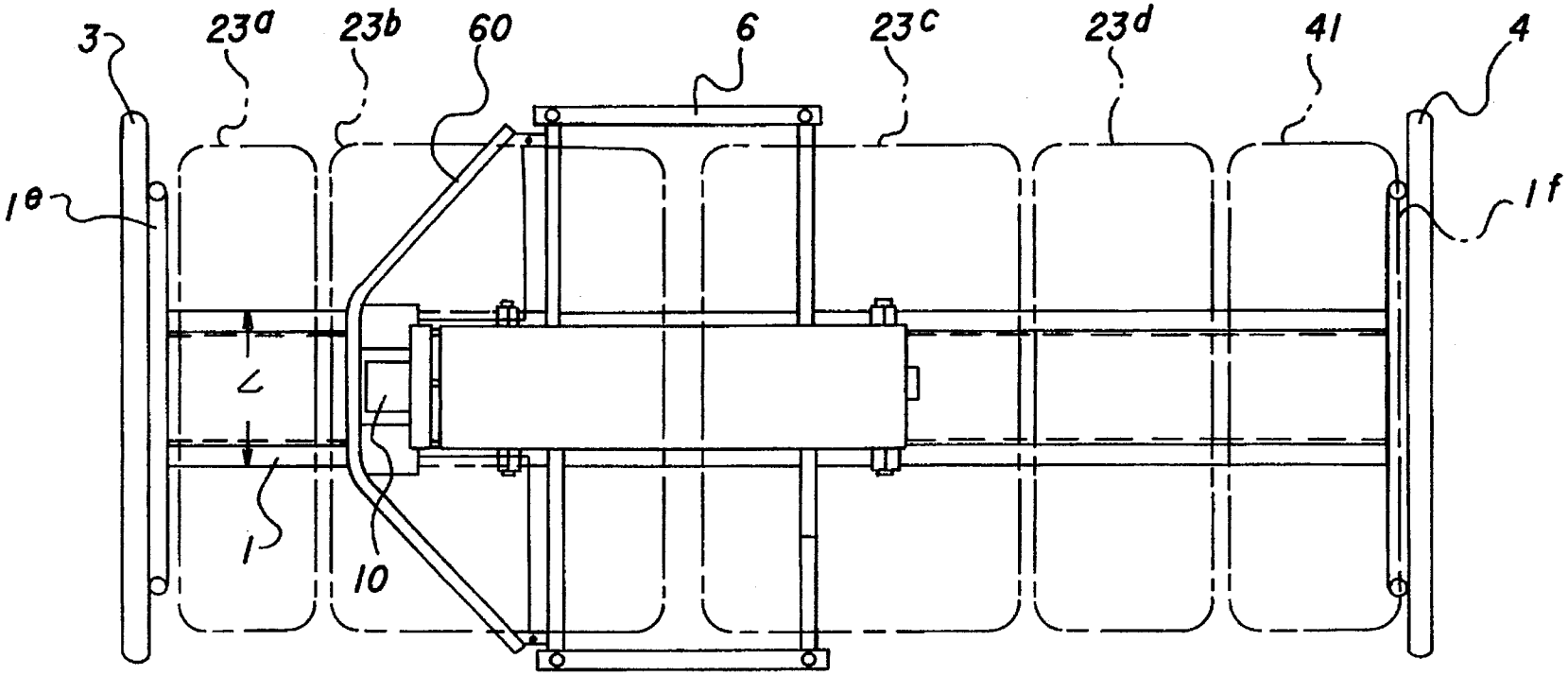
FIG. 3 is a partial plan view.
Figure 4:
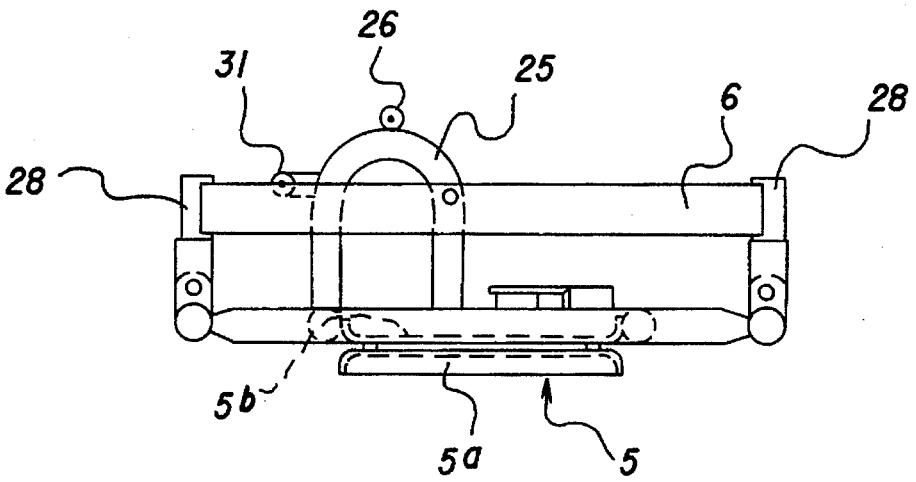
FIG. 4 is a partial side view.
Figure 5:
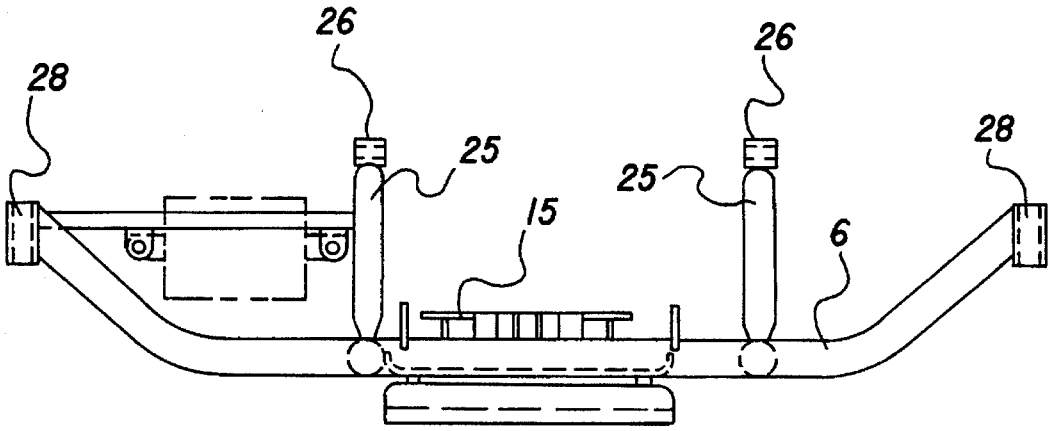
FIG. 5 is a partial front view.
Figure 6:
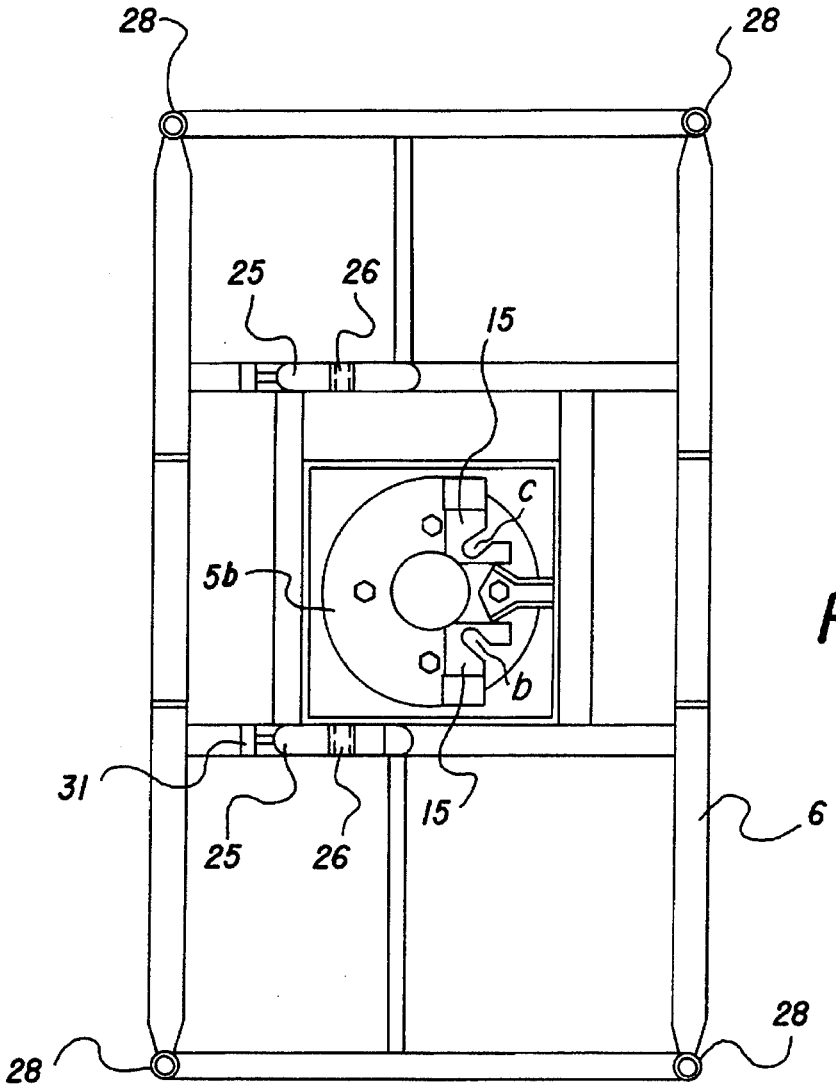
FIG. 6 is a partial plan view.
Figure 7:
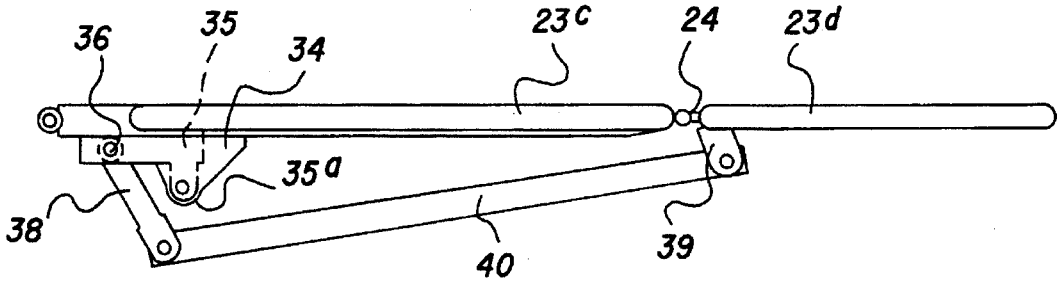
FIG. 7 is a partial side view.
Figure 8:
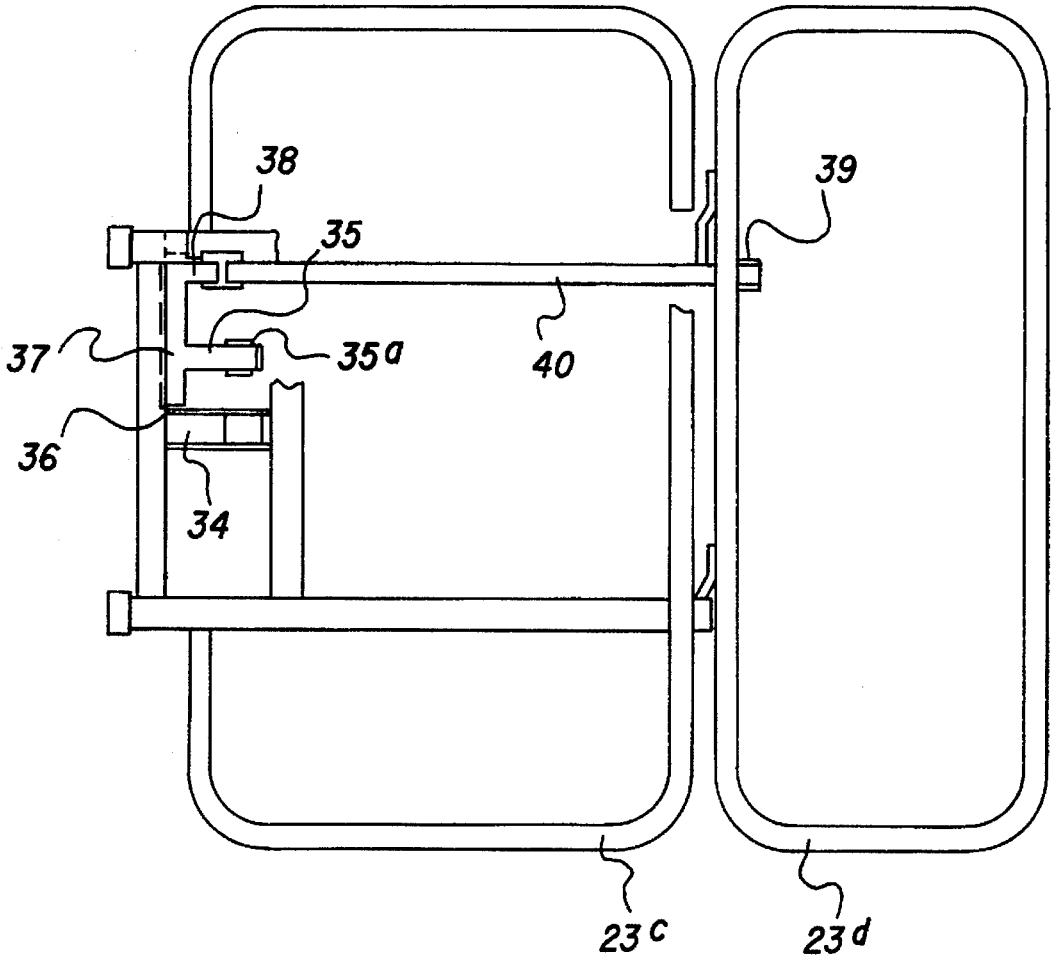
FIG. 8 is a plan view of FIG. 7.
Figure 9:
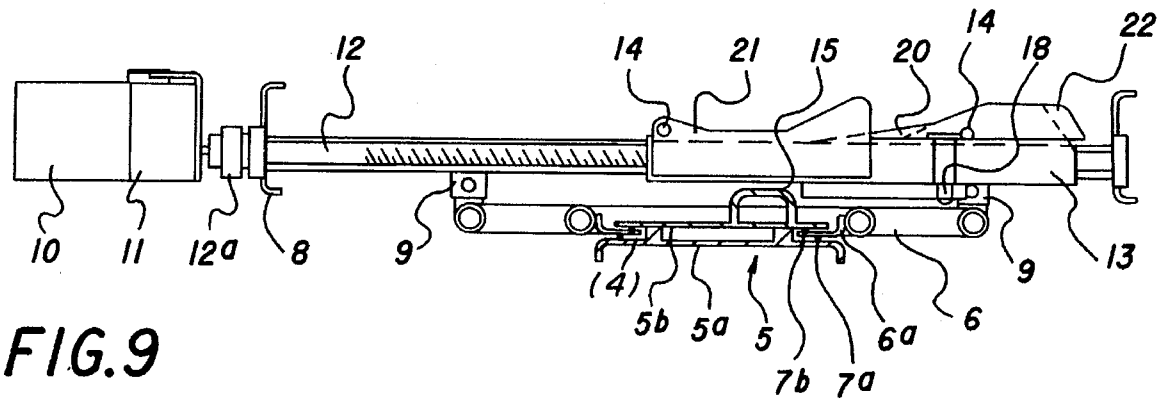
FIG. 9 is a partially cutaway side view.

The present invention will now be described in detail with reference to the drawings representing embodiments. In the drawings, 1 is a bed frame, the middle portion between the front and rear of which is lowered as viewed from a side. It has an overall width L and a height which permit easy stepping over and a narrow transverse width of 20 to 30 cm. Side frames 1*e* and 1*f* extend to the right and the left at the front and rear ends from the bed frame, and casters 2 are attached through a leg shift 2*a* to the right and left ends thereof. This bed frame 1 is divisible into a front frame 1*a*, a middle frame 1*b* and a rear frame 1*c*. The attaching/detaching mechanism will be described later in this specification. In the drawings, 3 is a front screen, and 4 is a rear screen. The front and rear screens 3 and 4 are secured to the side frames at the front and rear ends of the bed frame.

A fixed frame for rotation 5 is attached, to the middle frame 1*b*. This fixed frame 5 for rotation is composed of a lower sub-frame 5a and an upper sub-frame 5b so as to form the gap (a) above and below the outer circumference thereof.

The rotary bed frame 6 is secured to a plate 6a rotating in engagement with the gap (a) portion of the fixed frame 5 for rotation; and 7a and 7b are steel balls forming a bearing.

An operating mechanism support frame 8 is integrally supported by support legs 9, 9 . . . on the rotary bed frame 6 and is of the rectangular shape shown in the plan view.

The reversible motor 10 incorporates an integral reducer 11. This motor 10 with reducer is supported by the operating mechanism support frame 8. A screw shaft 12 rotated by the motor 10 is supported on bearings by the same operating mechanism support frame 8. Incidentally, 12a is a frictional clutch for safety which stops the shaft 12 by slipping when the load exceeds a certain level.

The reference numeral 13 indicates a screw cylinder which engages with the above-mentioned screw shaft 12. Shafts 14 and 14 projecting sideways are provided before and after the screw cylinder 13, and are attached with rollers 16, 16 . . . .

The screw cylinder 13 is thus prevented from rotating by following rotation of the screw shaft 12 by causing the rollers 16, 16 . . . to roll on the support frames 8a and 8b on the right and left sides.

A indicates a rotation mechanism. Projection-shaped fixed cams 15 and 15 having cam grooves (b) and (c) on the right and left sides are provided on the upper surface of the upper frame 5b of the above-mentioned fixed frame for rotation 5.

Holes 19 permitting insertion and removal of a pin 18 are provided in a cross plate 17 projecting to the right and left of the screw cylinder 13. In the state in which the pin 18 is inserted into any one of these holes, the motor 10 is caused to rotate to move the screw cylinder 13 to the motor 10 side under the effect of rotation of the screw shaft 12, so that the pin 18 engages in cam groove (b) or (c), and the inclination angle of this cam groove in the plan view twists the screw cylinder 13 on one side, thus causing rotation of the rotary bed frame 6 by about 90°. Rotation of the motor 10 is such that movement of the cross plate 17 pushes a switch SW1 so as to stop the rotary movable frame 6 after rotation by 90°. This switch SW1 for automatic stoppage may be provided at an appropriate position between the screw cylinder 13 side and the operating mechanism support frame 8 side, and it is not necessary to limit this position to that described in the above embodiment. In the same way reverse rotation of the motor 10 causes the rotary bed frame 6 to rotate by 90° in the reverse direction under just a reverse effect and to resume the original state.

The reference numerals 20, 21 and 22 indicate moving cams which are attached to the screw cylinder itself or to members secured to the screw cylinder as to move integrally with the screw cylinder 13, and conduct folding action of the back receiving part, the waist receiving part or the leg receiving part described later.

The reference numeral member 23 indicates a movable-side mat support which comprises a head receiving portion 23a, a back receiving portion 23b, a waist receiving portion 23c, and a leg receiving portion 23d. The head receiving part 23a and the back receiving portion 23b are connected by a folding hinge piece 24 and are provided in an integral form. The waist receiving portion 23c and the leg receiving portion 23d are similarly connected by a folding piece 24 and are provided in an integral form. The back receiving portion 23b and the waist receiving portion 23c are attached rotatably around the base ends thereof through a pin receiver 26 and a pin 27 to inverse-U shaped frames 25 and 26 secured at bases thereof to the rotary bed frame 6. The reference numerals 28, 28 . . . are cylinders for attaching siderails, which are secured to the four corners of the rotary bed frame 6.

The reference numeral 29 indicates a working ring of the head receiving portion 23a, which is an interlocking member causing a rod 31 to intervene between an arm integral with the head receiving portion 23a and the pin receiver 31 of the above-mentioned inverse-U shaped frame 25 to keep the head receiving portion 23a substantially horizontal when the back receiving part 23b is raised.

A mat 32 is placed on the above-mentioned movable side mat support 23: the mat is divided into sections by folding points to make it easy to fold. In the case of a thin mat, however, it is not necessary to take measures to facilitate folding such as providing notches in the mat.

The working arm 33 formed integrally with the back receiving portion 23b, is provided with a cam roller 33a which comes into contact with the moving cam 20 to direct folding action of the back receiving part 23b; 34 is a working bracket formed integrally with the waist receiving portion 23c, provided with a cam roller 34a which comes into contact with the moving cam 21 to direct folding action of the waist receiving portion 23c.

The working arm 35 for causing the folding action of the leg receiving portion 23d attached integrally to a bracket 37 connected by rotating shaft through a pin 36 to the working bracket 34 integral with the above-mentioned waist receiving portion 23c. A lever 38 is provided integrally with this bracket 37, so that the leg receiving portion 23d may be moved under the action of the working arm 35 by connecting this lever 38 and a lever 39 secured to the leg receiving portion 23d side with a rod 40. A cam roller 35a is attached to this working arm 35 to cause the cam roller 35a to come into contact with the moving cam 22.

A leg receiving mat support 41 is provided on the rear end side of the fixed bed frame 1, and a leg receiving mat 42 is placed in the upper portion thereof; and 43 indicates a regulation frame to prevent displacement of the mat.

The siderail 44 is composed of a cylinder 28 for attaching the siderail, a fixed siderail member 44a having a detachable pin from 28, and a movable siderail member 44b rotating outward and upward relative to the fixed siderail member 44a and stopping inside.

SW2 is a switch effecting automatic stoppage upon reverse rotation of the motor 10, attached to the support 8a, which causes stoppage when the cross plate 17 becomes far from the motor 10 and the mat support 23 becomes almost horizontal.

The switch operating box 45 is connected in linkage with motor 10 by an adjustable cord 46. A manual switch 3 enabling the user to freely select any of on, off, and positive and reverse rotation of the motor is provided on this box.

The guard 60 which safely encloses the space around the feet of the attendant M, is secured to the rotary bed frame 6, and has a construction in which the transverse width is narrower at the front end and becomes larger toward the rear end as viewed from the plan view.

In the above-mentioned construction of the embodiment, the relationship between rotation of the rotary bed frame 6 and folding action of the movable side mat support member 23 is ensured by the rotation mechanism A, and a folding action mechanism B comprising moving cams 20, 21 and 22, and cam rollers 33a, 34a and 35a coming into contact with these cams. The cams and the cam follower members (the pin 18, and the cam rollers 33*a*, 34*a* and 35*a*) which are related members conducting these actions are in the following positional relationship.

Figure 11:
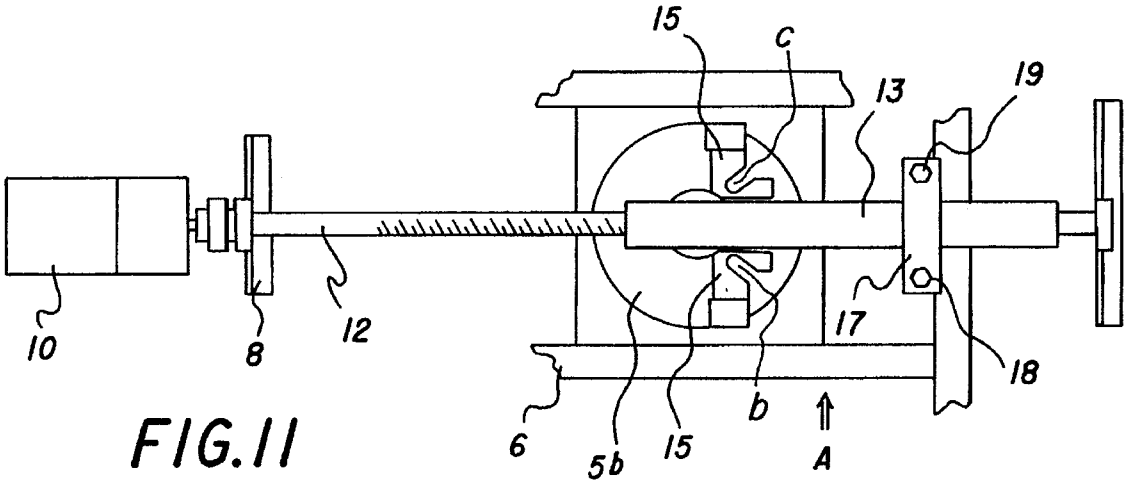
FIG. 11 is a partial plan view illustrating the function of a rotating mechanism A.
Figure 17:
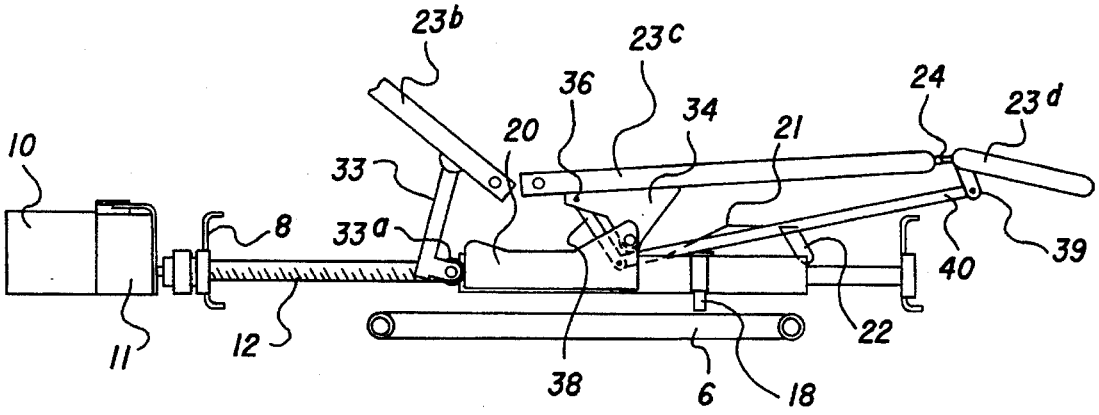
FIG. 17 is a partial descriptive view illustrating the operating mechanism of the movable mat support member 23.
Figure 22:
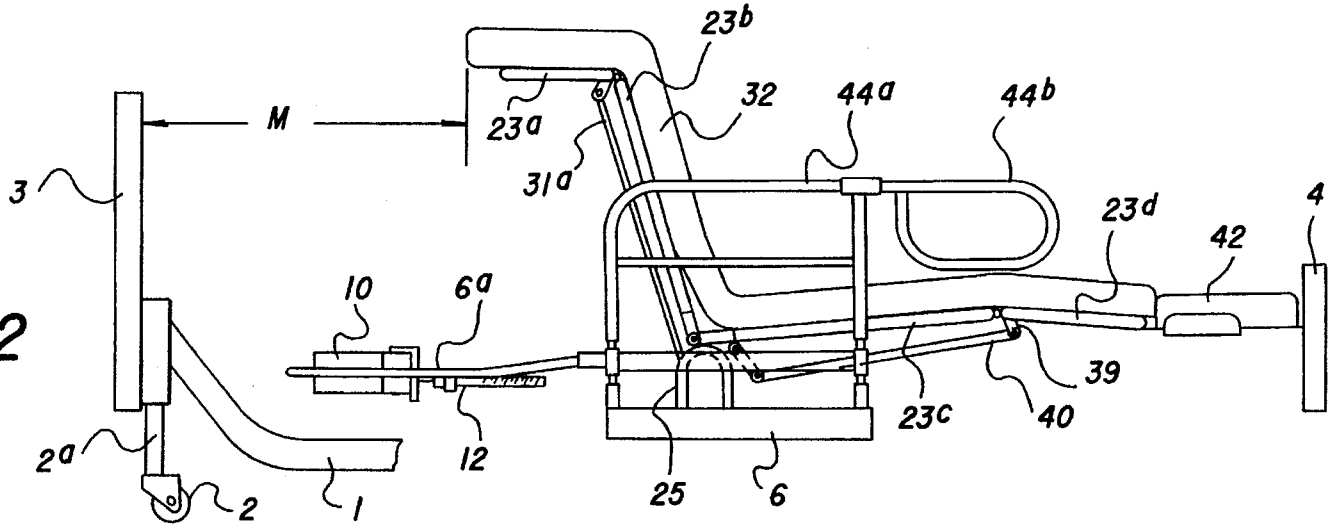
FIG. 22 is a side view for illustrating the strategic points in the overall movement of the rotary bed.

More specifically, when, under the effect of reverse rotation of the motor 10, the screw cylinder 13 moves away from the motor 10 and the switch SW2 is pushed by the cross plate 17 to become off, thus achieving stoppage, the individual cams and cam follower members are located at their respective basic positions in the state as shown in FIGS. 1 and 16. Then, accordingly as the motor 10 is rotated in the positive direction to bring the screw cylinder 13 nearer to the motor 10, the back receiving portion 23*b* is folded upward as shown in FIG. 17, and at the same time, the waist receiving portion 23*c* is raised up little by little to reach a state in which the leg receiving portion 23*d* does not fully follow the movement of the waist receiving 23*c*, but is slightly suspended. Subsequently, the leg receiving portion 23*d* is raised finally in the state shown in FIG. 18 into the state shown in FIG. 19. When the movement is discontinued in the state shown in FIG. 18, however, a gap M as shown in FIG. 22 is formed between the screen 3 and the front end of the mat 32 placed on the movable mat support member 23, into which an attendant K can enter. In this case, the transverse width L of the bed frame 1 is sufficiently narrow to enable the attendant to stand up on the floor surface by stepping over the frame 1, thus permitting easy care of a lying physically-handicapped or aged person from the back side of the patient. Then, at the stage in which the leg receiving portion 23*d* is raised up, the pin 18 begins being inserted into the cam groove (b) or (c) as shown in FIG. 11, to start rotary movement 6.

Figure 19:
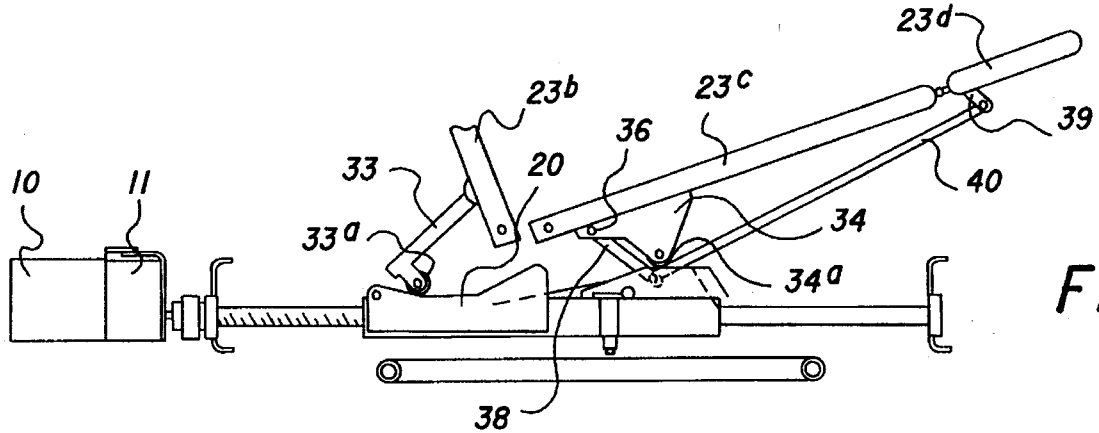
FIG. 19 is a partial descriptive view illustrating the operating mechanism of the movable mat support member 23.
Figure 21:
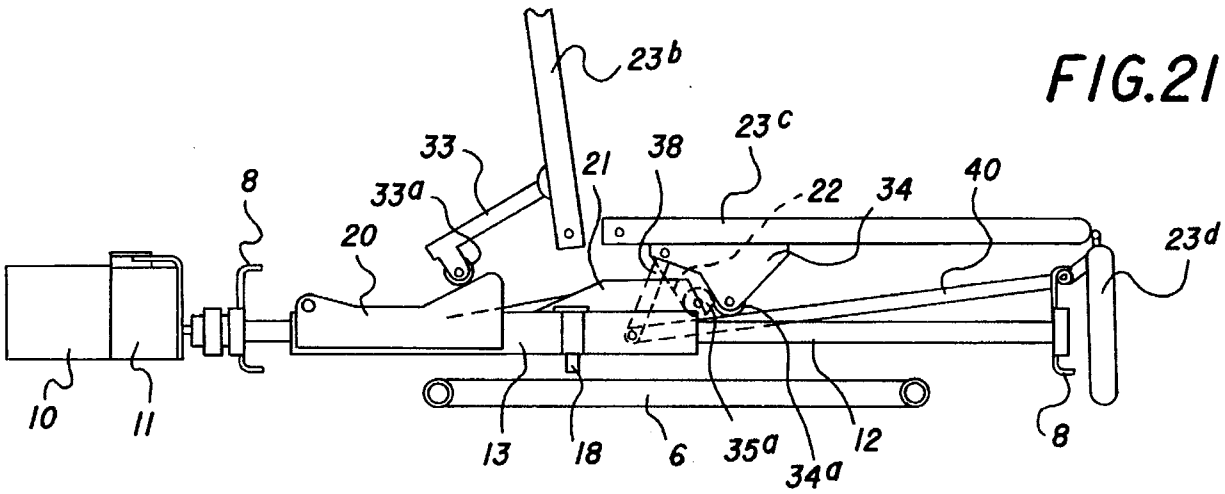
FIG. 21 is a partial descriptive view illustrating the operating mechanism of the movable mat support member 23.
Figure 26:
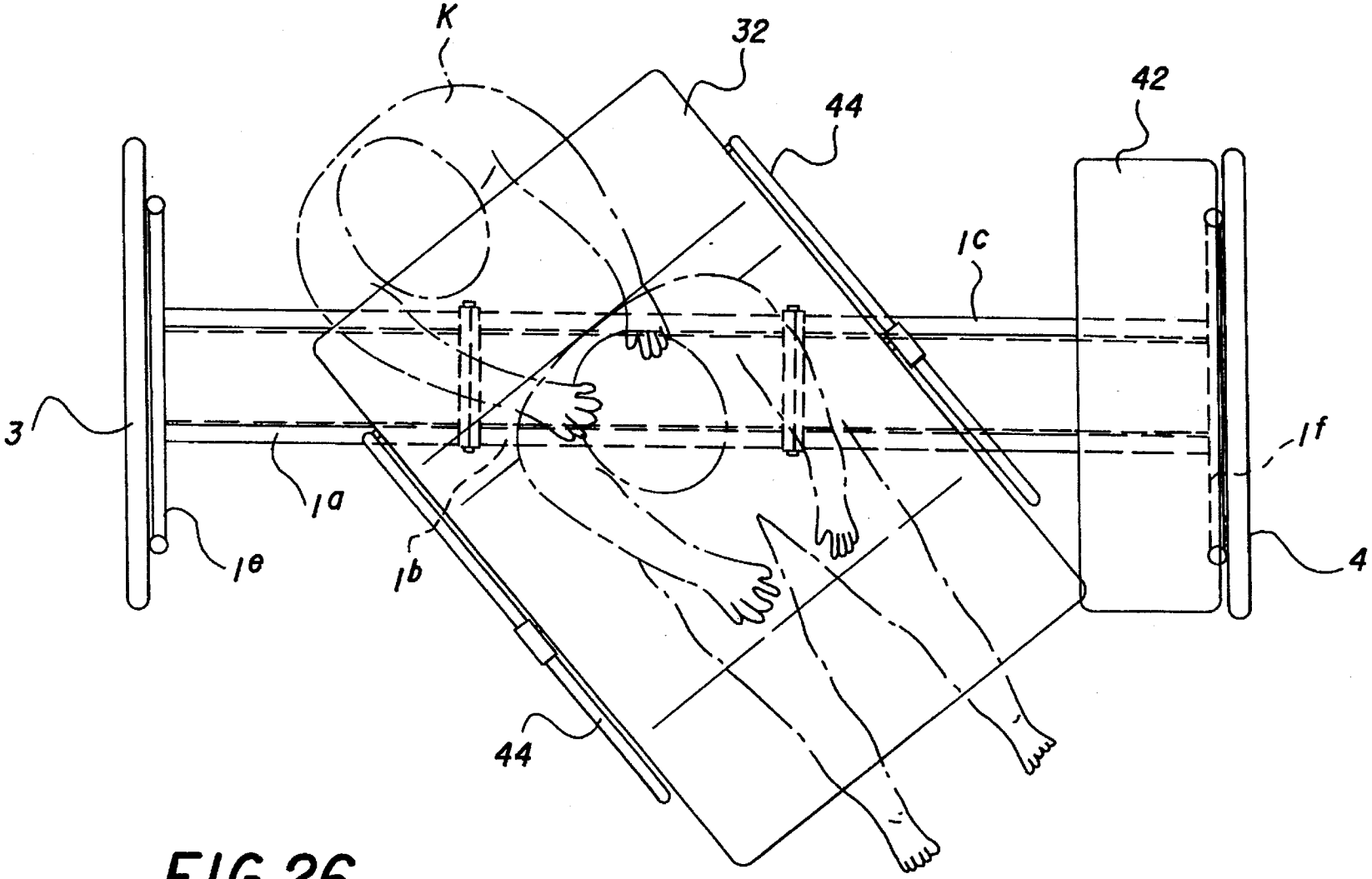
FIG. 26 is a plan view for illustrating the strategic points in the overall movement of the rotary bed.

At this point, even if the attendant K stands up at the gap M, the attendant K can easily escape to outside the bed frame 1 by stepping over the bed 26, as shown in FIG. 26, along with rotation of the bed 32, thus ensuring a high degree of safety. Then, the leg receiving portion 23*d* is kept in the uppermost state as shown in FIG. 19 during rotation. From the point when the bed has rotated by about 45°, the waist receiving portion 23*c* and the leg receiving portion 23*d* slowly begin resting the original state downward. Even after the waist receiving portion 23*c* reaches substantially the horizontal state, the leg receiving portion 23*d* hangs down almost vertically in a folded state as shown in FIG. 21. At this point, the rotary movable frame 6 also discontinues rotation under the effect of stoppage of the motor caused by the switch SW1.

When the motor 10 is rotated in the positive direction, just the reverse actions cause reverse rotation of the rotary bed frame 6, and the relative positions of the individual members are set so that the mat supports return to the original horizontal state. It is important to set the height of the holding action so that the raised position of the leg receiving part 23*d* should be largely apart upward from the upper surface of the fixed mat 42, and that the rotating rotary bed frame 6 does not cause the user's legs to be rubbed by the mat 42 or the movable mat 32. In the embodiment shown above, the height of folding action is set to accommodate this prerequisite.

Figure 18:
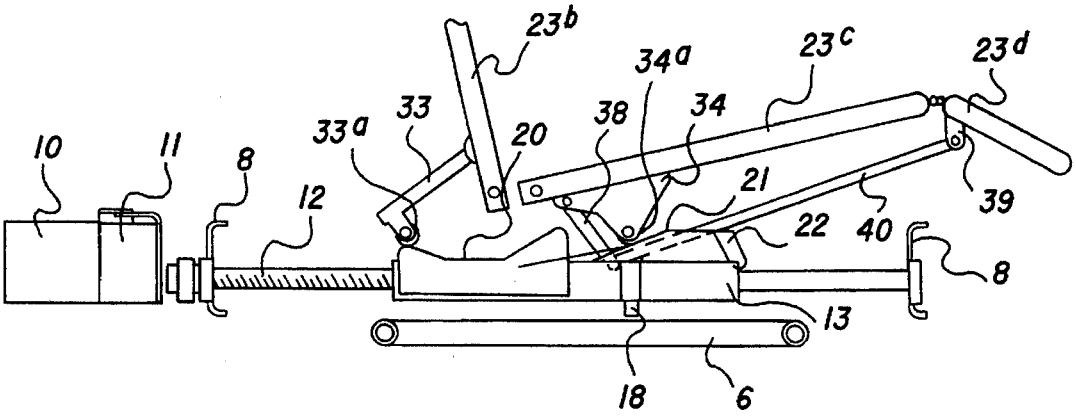
FIG. 18 is a partial descriptive view illustrating the operating mechanism of the movable mat support member 23.

The operations will now be sequentially described in more detail. When the motor 10 is rotated in the positive direction to cause the screw cylinder 13 to slowly move toward the motor 10, it presses the cam roller 33*a* towards the motor 10 on the back of the moving cam 20 and causes the back receiving portion 23*b* to gradually raised as shown in FIG. 17 through the working arm 33. Following this action, the cam roller 34*a* runs on the slope of the moving cam 21, thus causing the waist receiving portion 23*c* to tilt slightly. When the state shown in FIG. 18 is reached, the cam roller 35*a* in turn runs on the moving cam 22, thus raising the leg receiving portion 23*d* as shown in FIG. 19.

Figure 10:
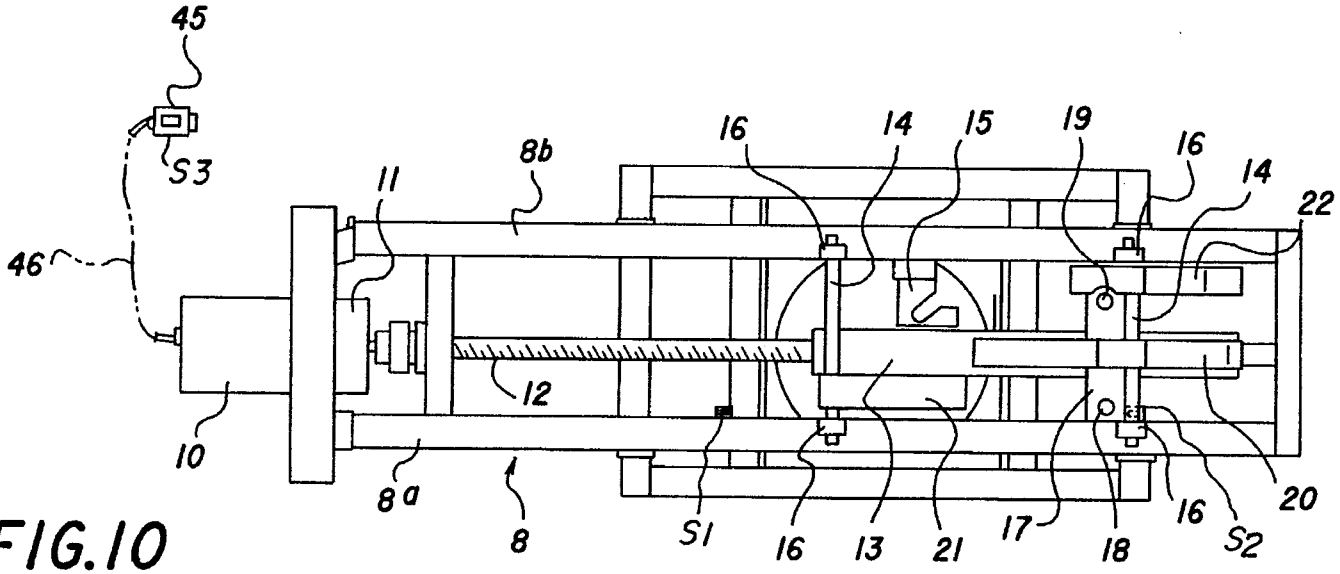
FIG. 10 is a plan view of FIG. 9.
Figure 12:
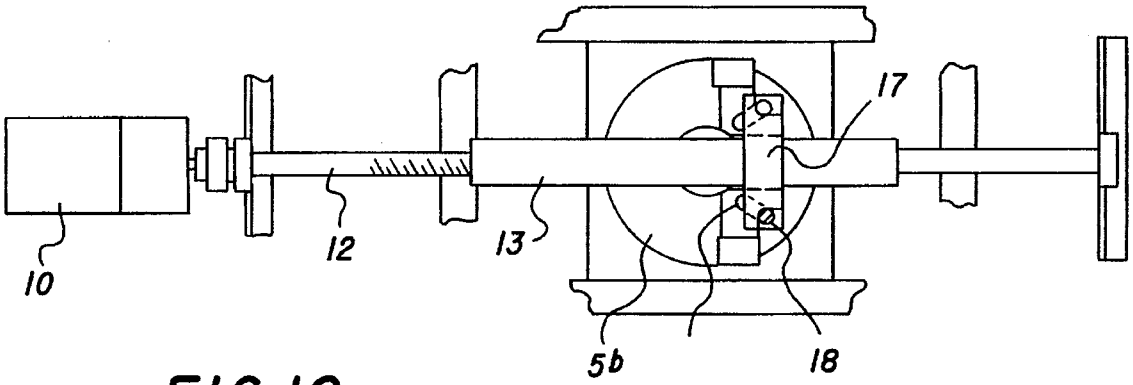
FIG. 12 is a partial plan view illustrating the function of the rotating mechanism A.
Figure 13:
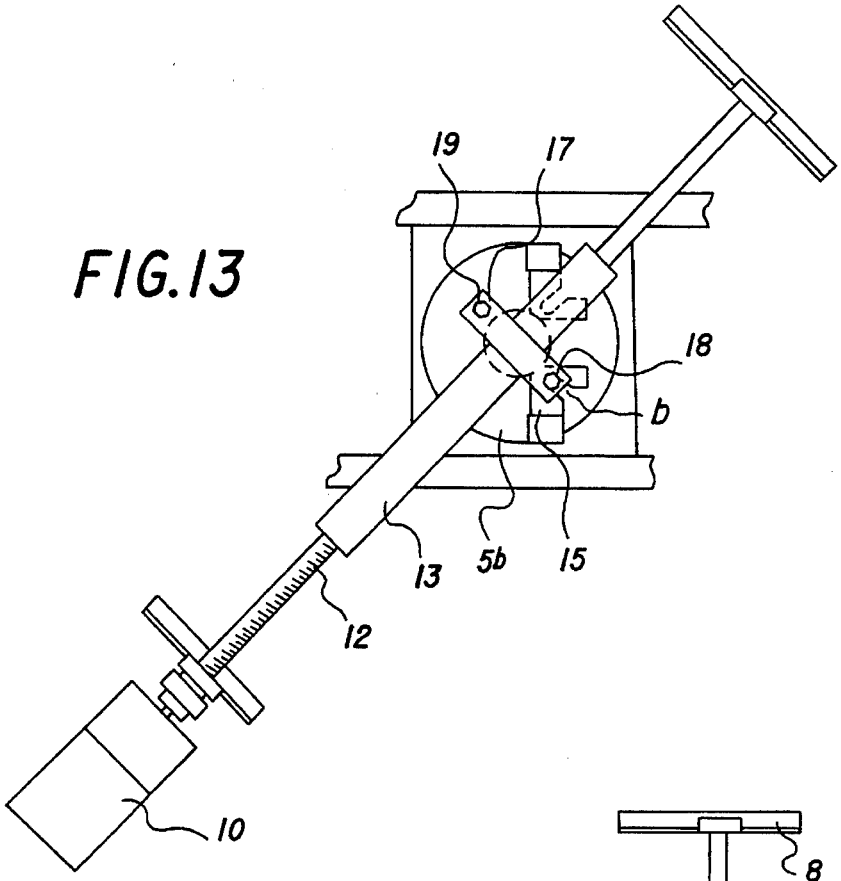
FIG. 13 is a plan view illustrating the function of the rotating mechanism A.
Figure 14:
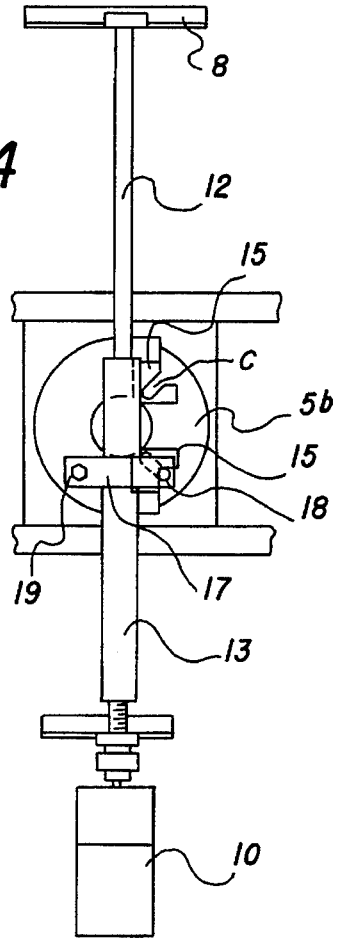
FIG. 14 is a partial plan view illustrating the function of the rotating mechanism A.
Figure 20:
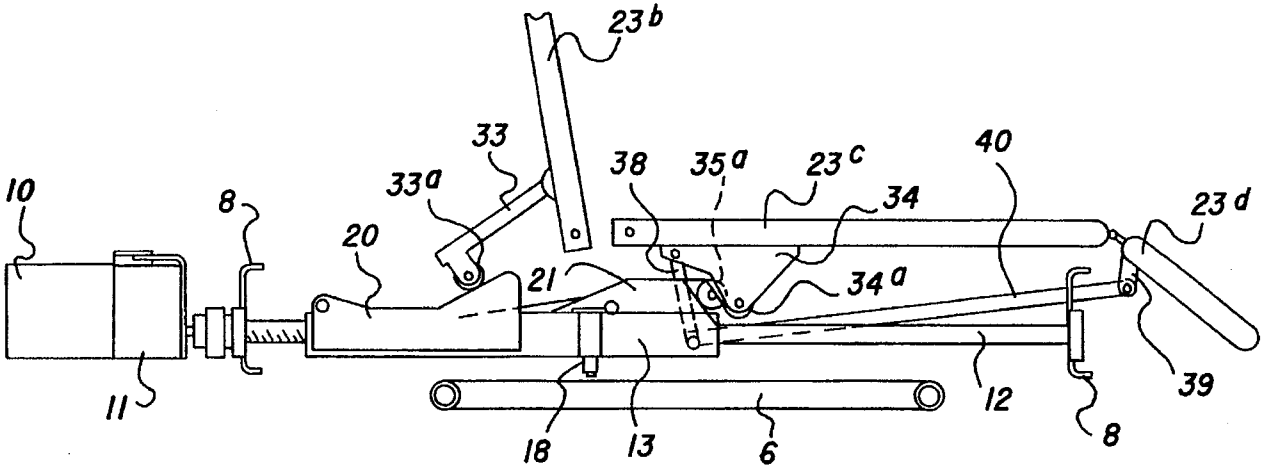
FIG. 20 is a partial descriptive view illustrating the operating mechanism of the movable mat support member 23.
Figure 23:
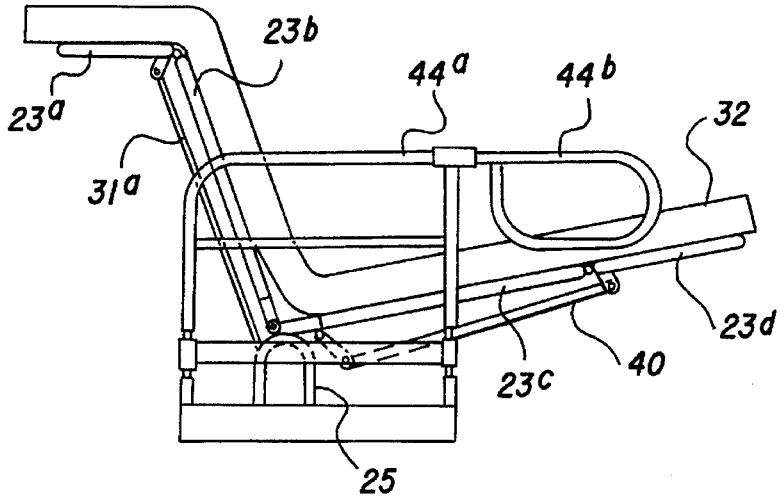
FIG. 23 is a side view for illustrating the strategic points in the overall movement of the rotary bed.
Figure 24:
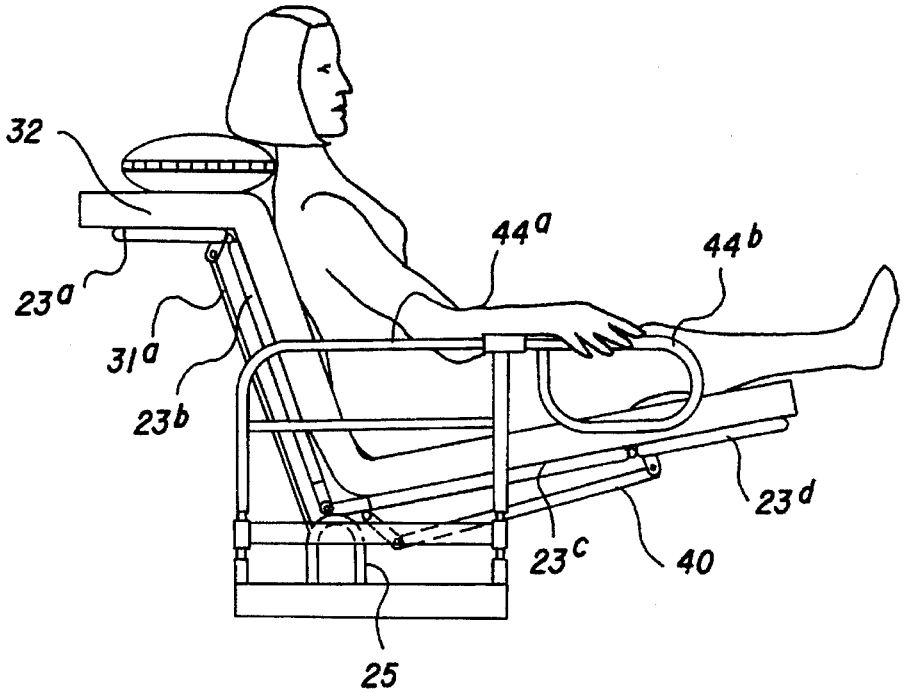
FIG. 24 is a side view for illustrating the strategic points in the overall movement of the rotary bed.
Figure 25:
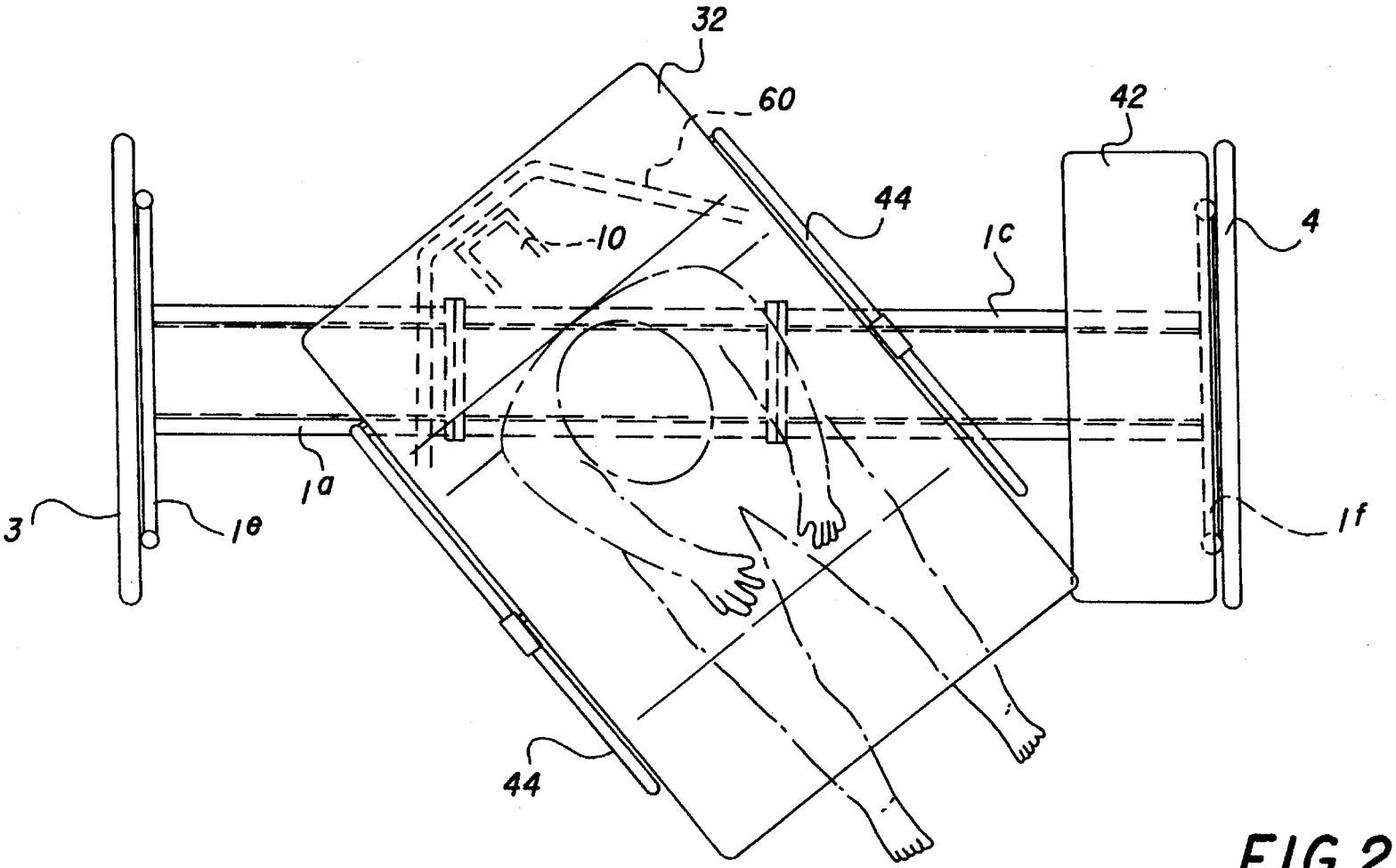
FIG. 25 is a plan view for illustrating the strategic points in the overall movement of the rotary bed.
Figure 27:
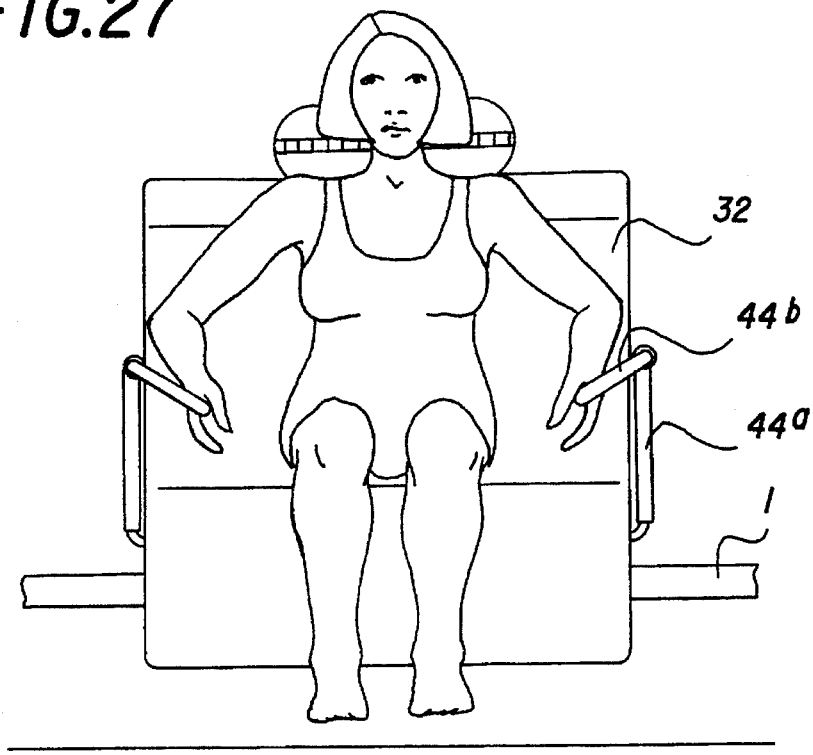
FIG. 27 is a side view for illustrating the strategic points in the overall movement of the rotary bed.

More particularly, the lying person takes a posture as shown in FIG. 23. The position of the screw cylinder 13 at this point is in or near the state shown in FIG. 12. While taking the posture shown in FIG. 24, the screw cylinder 13 displaces through the state shown in FIG. 13 to that shown in FIG. 14. In other words, when the cam pin 18 is previously set in the hole 19 to the left in FIG. 10, this pin 18 engages with the cam groove (b) and causes the operating mechanism support frame 8 (rotary bed frame 6), into which the motor 10 itself is incorporated, to rotate as shown in FIGS. 14 and 15. Along with these actions, the leg receiving portion 23*d* performs actions as shown in FIG. 21 through those shown in FIGS. 19 and 20. This means that the lying patient changes his or her posture from the state shown in FIG. 24 described above through the rotating posture shown in FIG. 25 finally into that shown in FIG. 27. More specifically, when the attendant K provides care, standing up between the front screen 3 and the front end of the bed 32 in the state shown in FIG. 24, and rotation unexpectedly occurs to the state shown in FIG. 25, the attendant K can go out to the side of the fixed bed frame 1 as shown in FIG. 26. This escape to outside frame 1 is very smooth since the attendant is spontaneously pushed off by the guard 60 of which the foot portion diverges toward the rear end. In this posture, the screw cylinder 13 is in its position closest to the motor 10, and the switch 1 is pushed by the cross plate 17 to turn off, thus causing automatic stoppage of the motor 10. By only continuing positive rotation of the motor 10 by means of the switch SW3 of the switch operating box 45, therefore, the lying patient is automatically caused to take a sitting posture in which the back is raised and the legs are stretched. In this posture, the leg receiving part 23*d* is raised to cause even the feet of the patient to be raised apart from the fixed mat. When the rotary frame 6 is rotated in this state to a position at which the feet of the patient are off the fixed mat surface as viewed in the plan, the leg receiving part 23*d* in turn hangs down in the state shown in FIG. 27. The patient would therefore be able to stand up on the floor while holding his or her own weight to some extent by hand by turning inward the movable siderail member 44*b* of the siderail 44. By the operations of reversing rotation of the motor 10 from the state shown in FIG. 15 and bringing the screw cylinder 13 more distant from the motor 10, it is possible in contrast to easily cause the standing patient to take the original lying posture typically represented by that shown in FIG. 1. The actions for this operation are just reverse to those causing the patient to stand up as described above. A detailed description is therefore omitted here.

Figure 28:
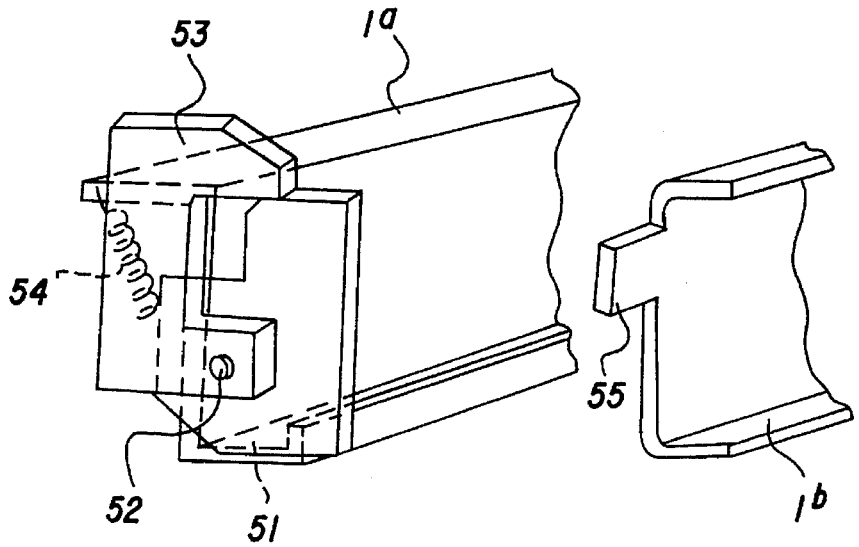
FIG. 28 is a perspective view illustrating the dividing portion of the bed frame.
Figure 29:
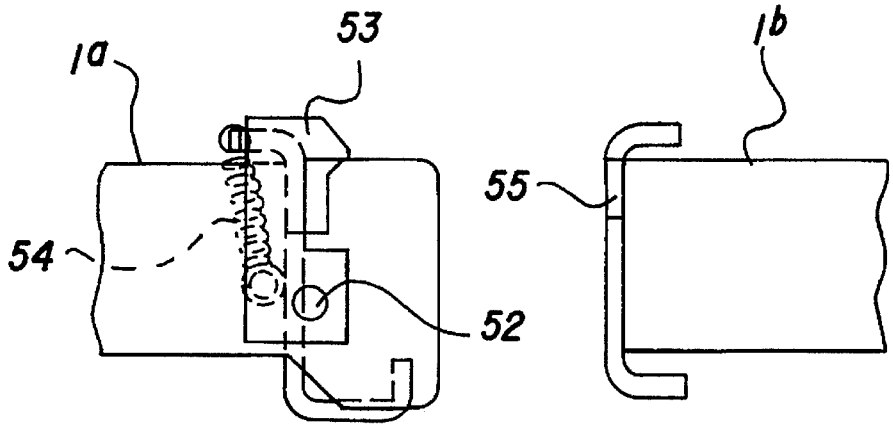
FIG. 29 is a partial side view illustrating the attaching/detaching operations of the bed frame.
Figure 30:
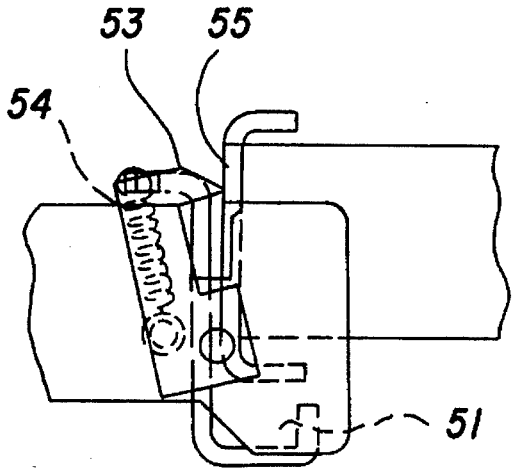
FIG. 30 is a partial side view illustrating the attaching/detaching operations of the bed frame.
Figure 31:
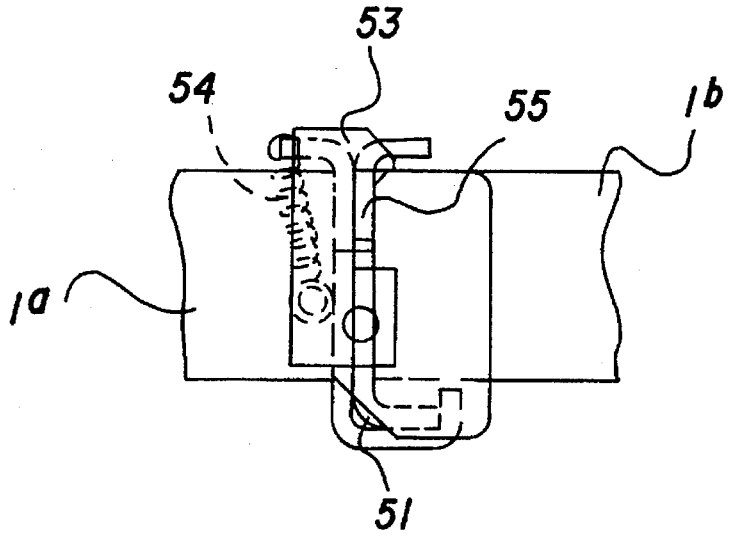
FIG. 31 is a partial side view illustrating the attaching/detaching operations of the bed frame.
Figure 32:
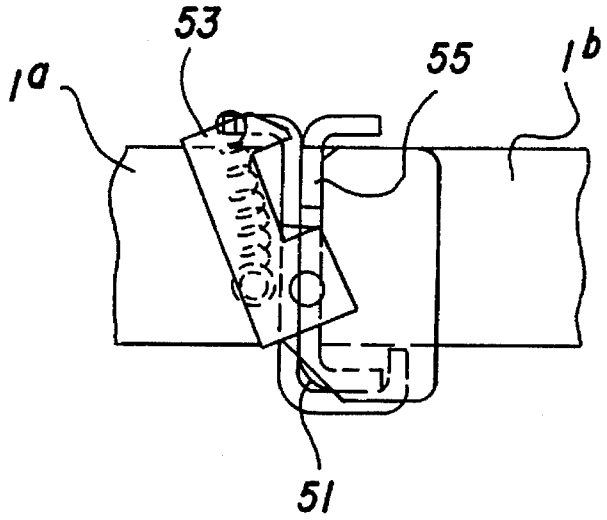
FIG. 32 is a partial side view illustrating the attaching/detaching operations of the bed frame.

The bed frame 1 is detachable, being divisible into the front frame 1*a*, the middle frame 1*b* and the rear frame 1*c* as described above. The attaching/detaching mechanism will be described below. As shown in the perspective view of the detached state in FIG. 28, a bottom anchoring part based on both frames is formed, which permits mutual engagement-anchoring of the bottom from above by holding the frame ends of the divisions of frame, and an anchoring claw 53 rotatable around a pin 52 is provided on a side of the frame for the upper portion. This is held by a spring 54 so as to be located above the other frame, to prevent the unexpected rising of the anchored frame. On the frame anchored from above, an ear 55 formed so as not to disturb frame engagement is provided, which pushes up the anchoring claw 53 when the both frames are brought into engagement from the front and the rear. The anchoring claw 53 engages with this ear 55. When assembling, therefore, it suffices to slightly raise one of the both frames, bring the both frames into contact, connect the frame higher in position, and at the same time, drop the same to cause anchoring with the bottom anchoring part 51. This connecting and assembling step is disclosed in FIGS. 29 to 32.

The holding means of the siderail used in the embodiment is illustrated in FIGS. 33 and 34. A locking claw 57 is provided on the frame side, which is rotatable so as to press a collar 56 on the siderail side.

COMMERCIALLY USEFUL EFFECTS

In the rotary-type bed of the present invention, as described above in detail, a narrow transverse width is used for the fixed bed frame 1 placed on the floor so as to enable the attendant K to easily step over. The rotary bed 6 is provided in the middle portion between the front and the rear of this bed frame 1. When a physically handicapped person is caused to take the sitting posture by raising the back receiving part of the rotary bed 6, the attendant K entering the gap between the front screen 3 and the upright back receiving part can easily provide care to the patient leaning against the back receiving part and can escape from the bed frame 1 to outside by easily stepping over the bed frame 1 without suffering from injury, thus providing useful for application in hospitals.

What is claimed is:

1. A rotary-type bed comprising a fixed bed frame having front and rear portions, a rotary bed frame disposed intermediate said front and rear portions of said fixed bed frame, means for rotating said rotary bed frame around a vertical axis, a front screen disposed on the front end and supported by a floor surface; a movable mat support member receiving a mat and being attached to said rotary bed frame, said mat support member including at least a back receiving portion, a waist receiving portion and a leg receiving portion, each of said portions being independently foldable; a leg receiving mat support receiving a mat for receiving legs provided on the rear end of the fixed bed frame; a reversely rotatable motor and a screw cylinder attached to a side of said rotary bed frame; a screw shaft rotatable at a reduced speed by the motor engaging said screw cylinder; a rotation mechanism for rotating the rotary bed frame by about 90° relative to movement of the screw cylinder and an interlocking mechanism operative to effect sequential folding of the back receiving portion, the waist receiving portion and the leg receiving portion, said rotation mechanism and said interlocking mechanisms being both disposed between the screw cylinder and the fixed bed frame, and said interlocking mechanism including means operative prior to starting rotation of the rotary bed frame and simultaneously with raising of the back receiving portion, to raise the leg receiving portion sufficiently to avoid the mat for receiving legs, and at least the front portion of the bed frame having a narrow width sufficient to permit stepping over.

* * * * *